US007810485B2

(12) United States Patent
Messmer

(10) Patent No.: US 7,810,485 B2
(45) Date of Patent: Oct. 12, 2010

(54) STACKED COOKING UNIT

(75) Inventor: Roger Messmer, 137 N. Skyview Dr., Jasper, IN (US) 47546

(73) Assignee: Roger Messmer, Jasper, IN (US)

( * ) Notice: Subject to any disclaimer, the term of this patent is extended or adjusted under 35 U.S.C. 154(b) by 74 days.

(21) Appl. No.: 10/832,194

(22) Filed: Apr. 26, 2004

(65) Prior Publication Data

US 2005/0235837 A1 Oct. 27, 2005

(51) Int. Cl.
*A47J 37/07* (2006.01)

(52) U.S. Cl. ..... 126/38; 126/9 R; 126/25 R; 126/50; 99/447; 99/444

(58) Field of Classification Search ..... 126/9 R, 126/25 R, 40, 50, 39 B, 38, 273 R, 333, 304 R, 126/305, 25 B, 9 B; 99/447, 444, 389, 390
See application file for complete search history.

(56) References Cited

U.S. PATENT DOCUMENTS 2,190,139 A 7/1938 Stockell
2,488,014 A 12/1945 Higman
2,573,211 A 6/1948 Manzler
2,517,254 A * 8/1950 Steele ..... 126/9 R
2,786,463 A 10/1953 Vincent
3,046,969 A 7/1962 Davis
3,091,170 A * 5/1963 Wilson ..... 99/390
3,224,357 A 12/1965 Rubens
3,827,423 A 8/1974 Bolitho
3,851,639 A 12/1974 Beddoe
4,140,049 A 2/1979 Stewart
4,495,860 A * 1/1985 Hitch et al. ..... 126/9 R
4,574,776 A * 3/1986 Hidle ..... 126/369
4,649,811 A * 3/1987 Manganese ..... 99/417
4,722,322 A * 2/1988 Varney et al. ..... 126/261
4,777,927 A 10/1988 Stephen et al.
4,850,333 A * 7/1989 Dellrud et al. ..... 126/25 A
4,932,390 A 6/1990 Ceravolo
5,163,359 A * 11/1992 McLane, Sr. ..... 99/447
5,431,093 A * 7/1995 Dodgen ..... 126/25 R
5,768,977 A * 6/1998 Parris et al. ..... 99/340
5,836,295 A 11/1998 Faraj
5,865,101 A * 2/1999 Brown ..... 126/20
5,918,536 A * 7/1999 Cheng ..... 99/447
6,029,566 A * 2/2000 McLemore ..... 99/447
2003/0234014 A1 12/2003 Fitzgerald
2004/0000303 A1 1/2004 Regen et al.

FOREIGN PATENT DOCUMENTS

DE 38 24 413 A1 * 1/1990

* cited by examiner

*Primary Examiner*—Steven B McAllister
*Assistant Examiner*—Sarah Suereth
(74) *Attorney, Agent, or Firm*—Armstrong Teasdale LLP

(57) ABSTRACT

A cooking unit includes a base pan, a can positioned on the base pan, and a cooking drum located on the base pan and within the can. The cooking unit also includes a heat source positioned outside the can.

13 Claims, 8 Drawing Sheets

STACKED COOKING UNIT

BACKGROUND OF THE INVENTION

This invention relates generally to cooking units, and more particularly to cooking units in which the food is not placed directly over the heat source.

Outdoor cookers have traditionally been used to cook meats and vegetables, as well as other foods, over an open flame. Typically this outdoor cooking increases flavor, decreases mess within a home, and provides for a convenient cooking method. The typical arrangement is to place food on a rack over an open flame. However, it has been found that placing the food directly over an open flame can cause the food to cook unevenly, depending on the amount of heat being generated by the heat source at each position in the heat source. In addition, flame-ups occur as a result of juices and fats dripping from the food onto the heat source. These flame-ups may cause burning of the food, a generally undesired aspect of cooking over an open flame. Further, when the food is located in the same container as the heat source, the container cannot typically be sealed as the flame uses air in the burning process. Thus, the food typically will dry out faster than if it were cooked in a sealed container.

BRIEF DESCRIPTION OF THE INVENTION

In one aspect, a cooking unit is provided that includes a base pan, a can positioned on the base pan, and a cooking drum located on the base pan and within the can.

In another aspect, a cooking unit is provided that includes a base pan, a can including a side wall, and a top connected to the side wall. The can is configured to rest on the base pan. The cooking unit also including a cooking drum including a side wall. The cooking drum is configured to rest on the base pan and within the can.

In another aspect, a method of assembling a cooking unit is provided. The method includes positioning a base pan on a surface. The method also includes positioning a cooking drum on the base pan and positioning a can on the base pan such that the heat source is located outside the can and the cooking drum is located inside the can.

DETAILED DESCRIPTION OF THE INVENTION

Exemplary embodiments of methods and apparatus for stacked cooking units are described below. In one embodiment, the stacked cooking unit includes a base pan, a can positioned on the base pan, and a cooking drum positioned within the can. Racks are placed within the cooking drum while the heat source is located on the base pan outside of the can.

Although exemplary embodiments are described herein, the methods and apparatus are not limited to those specific embodiments. For example, although methods and apparatus are described for a charcoal heat source, in other embodiments, the unit utilizes a gas heat source or an electric heat source. In addition, although the cooking unit includes a hinged access door on the top of the can, other types of doors can be utilized such as removable doors, rotatable doors, and other types of pivoting doors.

The apparatus and methods are illustrated with reference to the figures wherein similar numbers indicate the same elements in all figures. Such figures are intended to be illustrative rather than limiting and are included herewith to facilitate explanation of an exemplary embodiment of the methods and apparatus of the invention.

Figure 1:
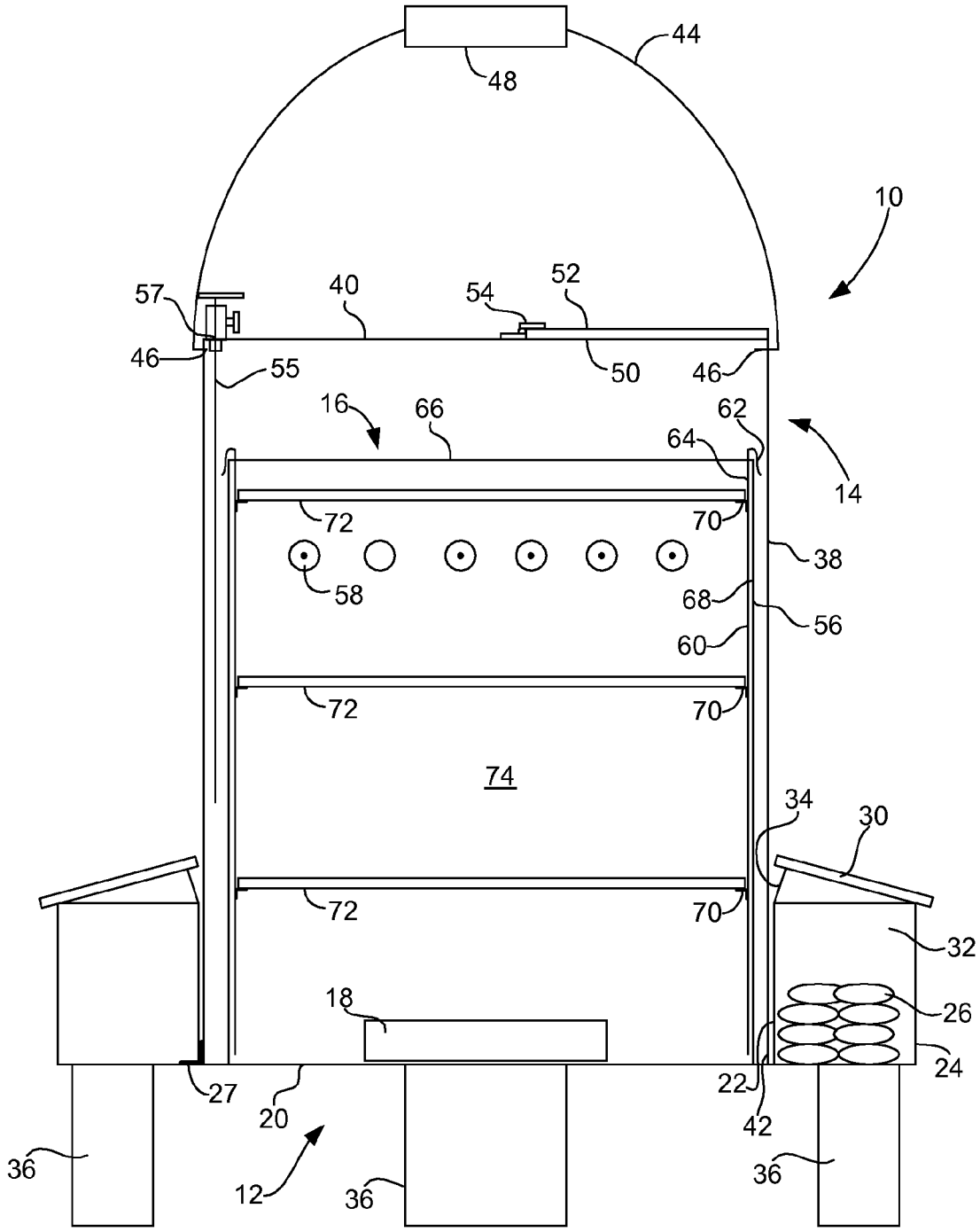
FIG. 1 is a cross sectional view of a cooking unit including a base pan, a can, and a cooking drum in accordance with one embodiment of the present invention.

FIG. 1 is a cross sectional view of a cooking unit 10 including a base pan 12, a can 14, a cooking drum 16, and a drip pan 18. Base pan 12 includes a base 20, an inner wall 22 extending from base 20, and an outer wall 24 extending from base 20. Outer wall 24 is spaced from inner wall 22 a sufficient distance to enable a heat source 26 to be contained by base pan 12 and located between inner wall 22 and outer wall 24. Heat source 26, as shown in FIG. 1, is charcoal which is placed between walls 22 and 24. Alternatively, the heat source is a gas fed flame. In a further alternative, the heat source is an electric heater. In one embodiment, base pan 12 is circular in shape and inner wall 22 and outer wall 24 form concentric circular shapes extending from base 20.

In one embodiment, walls 22 and 24 are unitary with base 20. In an alternative embodiment, walls 22 and 24 are connected to base 20 by welding or fasteners. In a further embodiment, outer wall 24 is fixed to, or unitary with, base 20 and inner wall 22 is positioned on base 20 and held in place with a plurality of retainers such as clips 27. Alternatively, walls 22 and 24 are both positioned on base 20 and held in place with a plurality of retainers such as clips 27.

Base pan 12 also includes a covering member 30 extending from outer wall 24 to inner wall 22. Covering member is ring shaped and sized to completely cover an opening 32 between inner wall 22 and outer wall 24. Alternatively, covering member 30 is sized smaller or larger than opening 32 and has the shape formed by opening 32. Covering member 30 is configured to contact outer wall 24 and be spaced above inner wall 22 such that heat can escape opening 32 in a direction toward can 14. Outer wall 24 and inner wall 22 include a plurality of openings (not shown in FIG. 1) that permit air to enter opening 32. An extension member 34 extends from inner wall 22 and contacts covering member 30. Extension member 34 maintains covering member 30 a specified distance from inner wall 22 and creates a space between inner wall 22 and covering member 30. In one embodiment, extension member 34 is a handle utilized to position inner wall 22 with respect to base 20 and extension member 34 is welded to inner wall 22. In a further embodiment, extension member 34 is pivotally attached to inner wall 22 such that it can be lowered and covering member 30 allowed to contact inner wall 22 and close cover opening 32. Alternatively, extension member 34 is clipped to inner wall 22 and is removable therefrom. In a further alternative, base pan 12 further includes an opening 28 extending through base 20 that functions as a drain to allow the drippings from the cooking food to escape from an area in which the food is cooking.

Base pan 12 also includes a plurality of feet 36 extending from base 20. In one embodiment, three feet 36 extend from base 20. Alternatively, four or more feet could extend from base 20 to support cooking unit 10.

Can 14 includes a side wall 38 and a top 40. Side wall 38 is formed into a tubular shape and includes a bottom 42 that contacts base 20. Bottom 42 is spaced a short distance from inner wall 22. Can 14 also includes a handle 44 attached near top 40. Handle 44 is a shaped metal rod. Can 14 includes a pair of openings (not shown) through which ends 46 of handle 44 extend. Top 40 is a solid metal sheet having a circular shape and is attached to side wall 38. In one embodiment, handle 44 includes a grip portion 48 to be contacted by a user when it is desired to move can 14 while it is still hot. Grip portion 48 is fabricated from a material that does not conduct heat, such as wood or plastic.

Top 40 includes an access opening 50 extending therethrough. A door 52 is attached to top 40 and is configured to cover at least a portion of opening 48. Door 52 is connected to top 40 with a hinge 54 such that it can be opened with respect to opening 50. Alternatively, door 52 is attached to top 40 with a pin or bolt and is configured to rotate over and away from opening 50. Further, door 52 may be attached to top 40 with any means that allows door 52 to cover and uncover opening 50.

Can 14 also includes a fill opening 57 through which liquid may be added to the cooking area. In one embodiment, fill opening 57 is used to add water directly to base pan 12. The addition of water to base pan 12 cools the base pan. Opening 57 is sized to at least partially hold a thermometer 55 when thermometer 55 is placed through opening 57 to determine a temperature of the cooking area. Alternatively, the liquid is added directly to base pan 12.

Cooking drum 16 includes a tubular side wall 56 comprising a plurality of openings 58 extending therethrough. At least one rack holder 60 is attached to side wall 56. Rack holder 60 includes a lip 62 at a top 64 thereof. Lip 62 is positioned over a top 66 of side wall 56 such that a remainder of rack holder 60 extends along an inside surface 68 of side wall 56. Rack holder 60 also includes an extension member 70 for each rack to be placed within cooking drum 16. In one embodiment, three rack holders 60 are attached to side wall 56. In an alternative embodiment, more than three rack holders are utilized. In a further alternative embodiment, rack holders 60 are integral with side wall 56 and extension members 70 contact and extend from side wall 56. A plurality of cooking racks 72 are positioned within cooking drum on rack holder extension members 70 within a cooking area 74.

Figure 2:
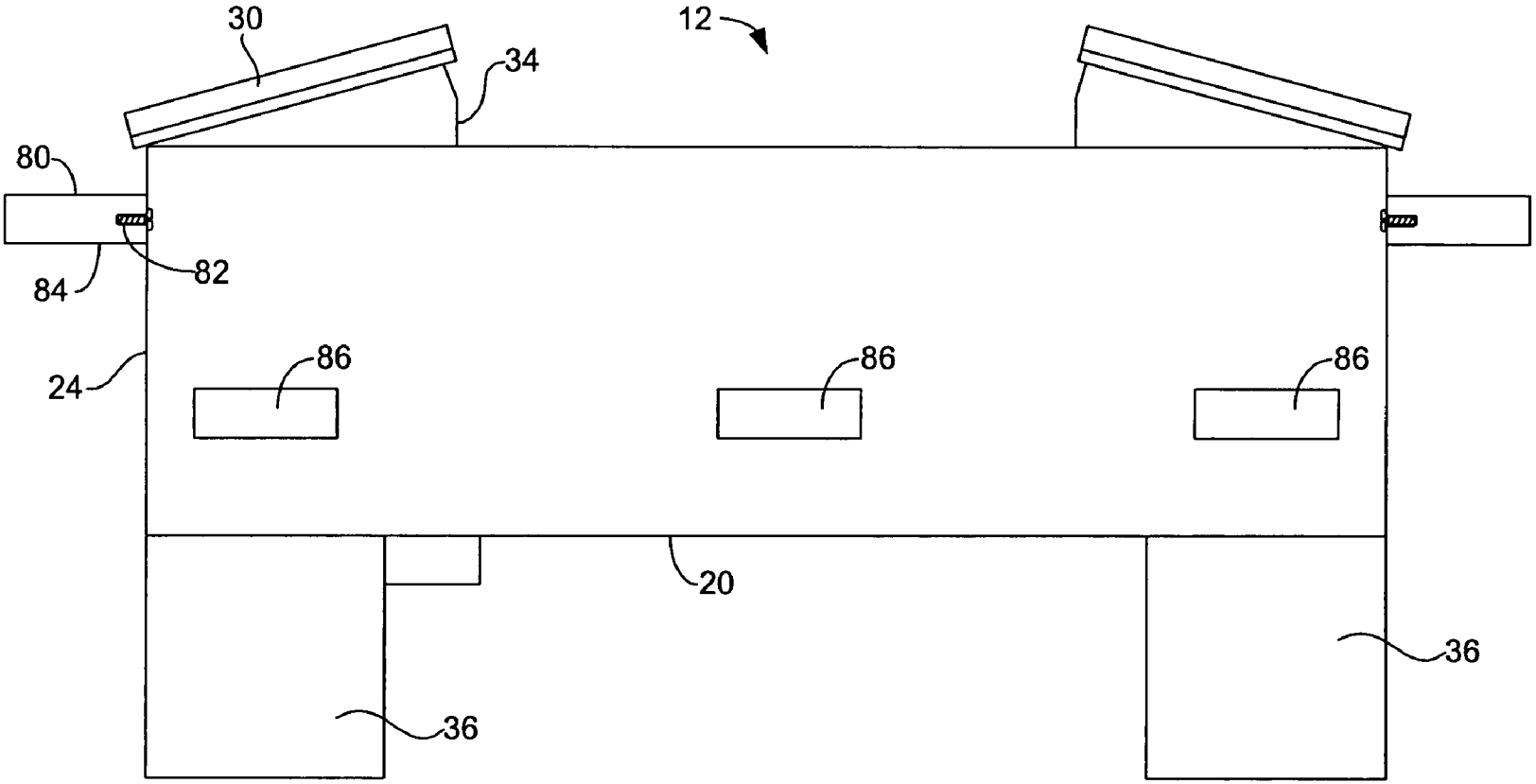
FIG. 2 is a side view of the base pan shown in FIG. 1.
Figure 3:
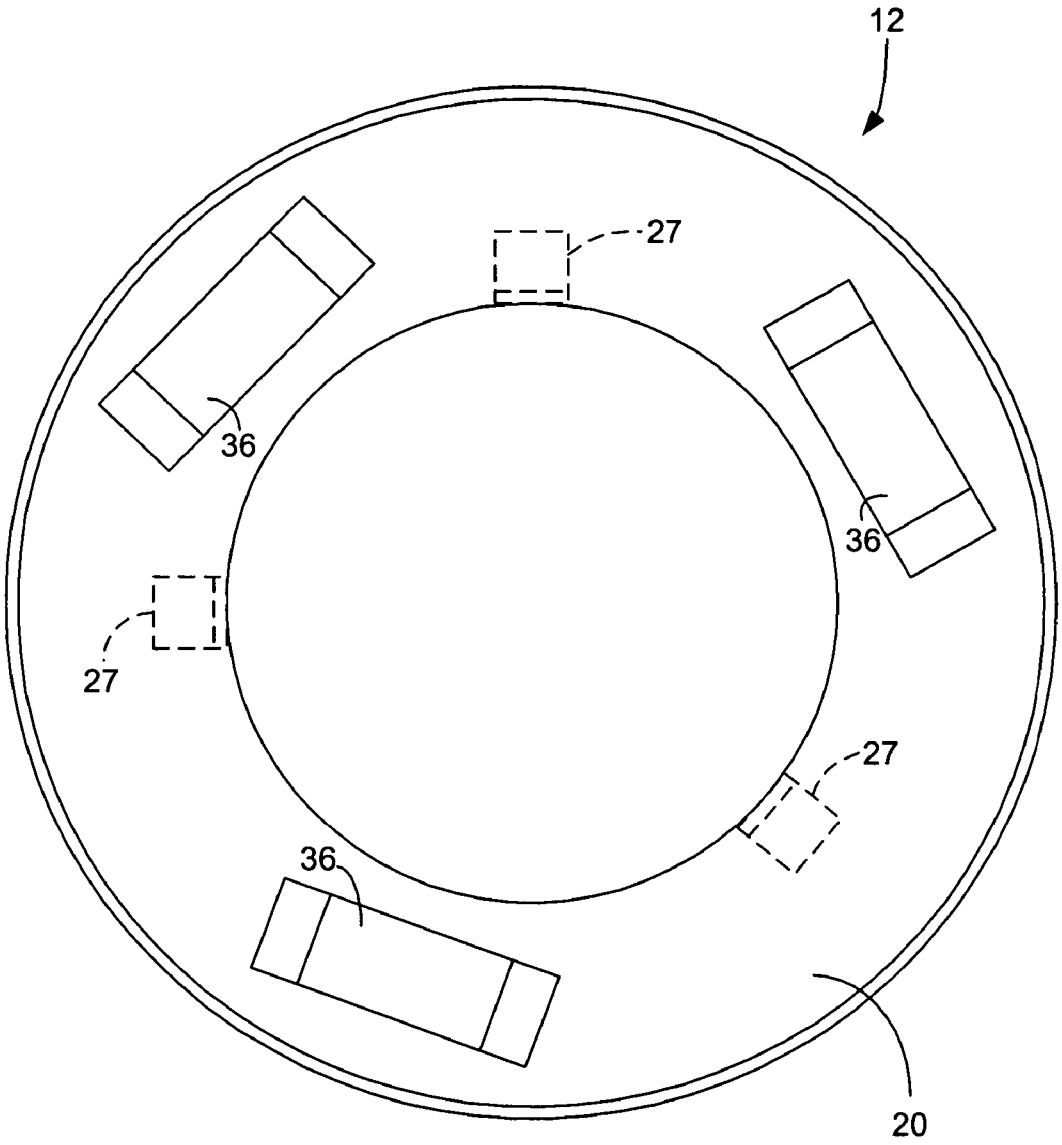
FIG. 3 is a bottom view of the base pan shown in FIG. 2.

FIG. 2 is a side view and FIG. 3 is a bottom view of base pan 12. As shown in FIG. 2, base pan 12 includes a pair of handles 80 extending from outer wall 24. Handles 80 are fixedly attached to outer wall 24 by welding. In another embodiment, handles 80 are attached to outer wall 24 with fasteners 82 such as screws, bolts, or pins. In a further embodiment, handles 80 are attached to outer wall 24 using solder. Handles 80 include an attachment portion 84 and a gripping portion (not shown). Attachment portion 84 is, in one embodiment, fabricated from metal and the gripping portion is fabricated from a material that does not conduct heat, such as wood or plastic. Alternatively, attachment portion and the gripping portion are both fabricated from a material that does not conduct heat, such as wood or plastic. Base pan 12 also includes a plurality of openings 86 extending through outer wall 24. Openings 86 provide air to heating source 26 (not shown in FIG. 2).

In one embodiment, base pan 12 has a circular shape with a diameter of 19 inches and a height of 4.0 inches. Outer wall 24 is attached to base 20 by welding. Alternatively, outer wall 24 and base 20 are unitary. Base 20, outer wall 24 and inner wall 22 (not shown in FIG. 2) are fabricated from 16 gauge stainless steel, although other thicknesses of material and even other material can be used for the fabrication. In one embodiment, a catch pan (not shown) is included.

As shown in FIG. 3, feet 36 are welded to base 20 and are spaced equidistantly. In addition, clips 27 are spaced equidistantly from each other. Although three feet 36 and three clips 27 are illustrated in FIG. 3, it should be understood that more or less than three feet 36 and three clips 27 may also be utilized.

Figure 4:
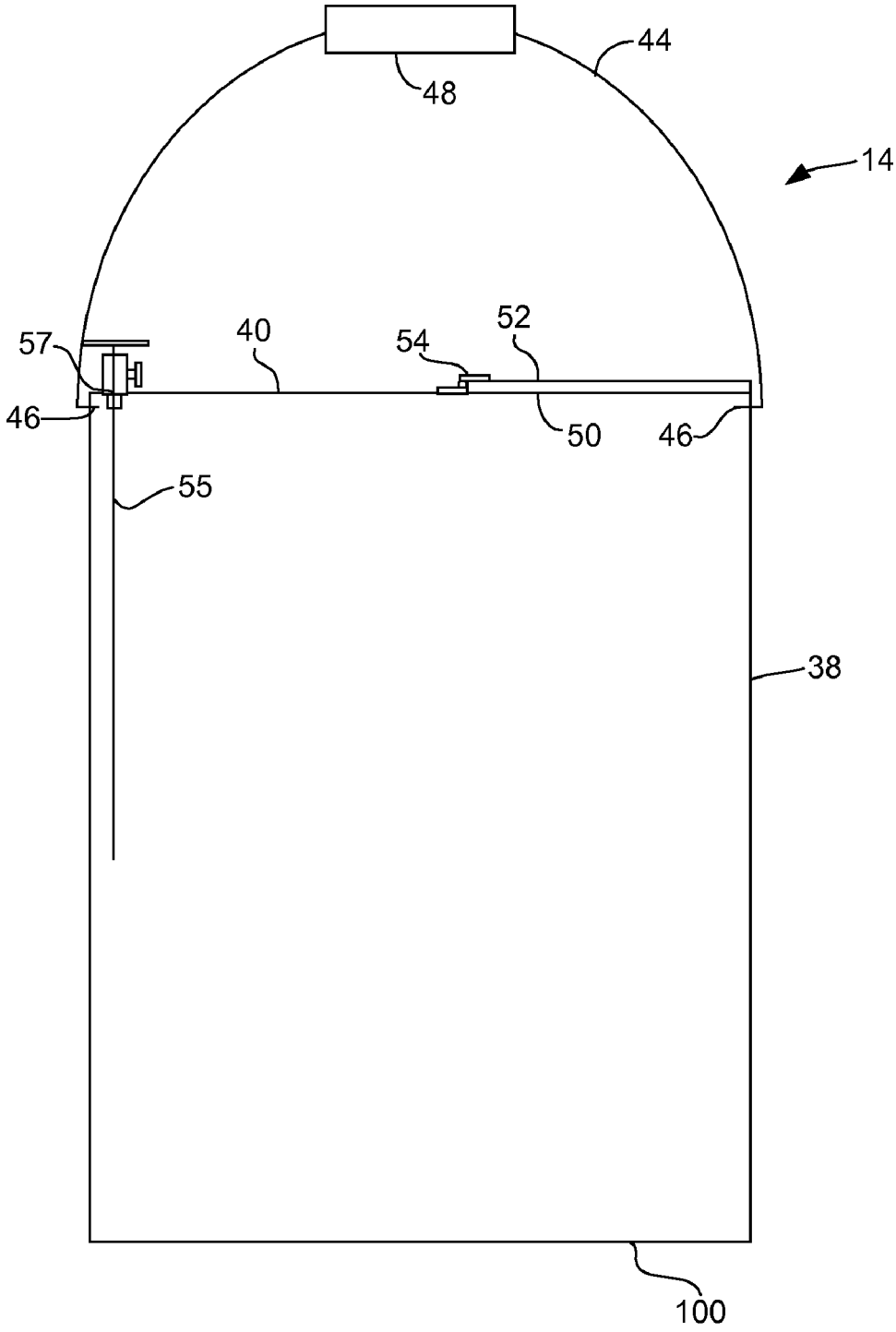
FIG. 4 is a partial cut away view of the can shown in FIG. 1.

FIG. 4 illustrates a cut away view of can 14. Can 14 is fabricated from a metal, such as stainless steel. In one embodiment, can 14 has a circular shape with a diameter of 12 inches, is 17 inches high, and is fabricated from 16 gauge stainless steel. Side wall 38 has a tubular shape with an open bottom 100 and a top 40. As described previously, can 14 includes a handle 44 that attaches to can 14 near a top thereof.

Figure 5:
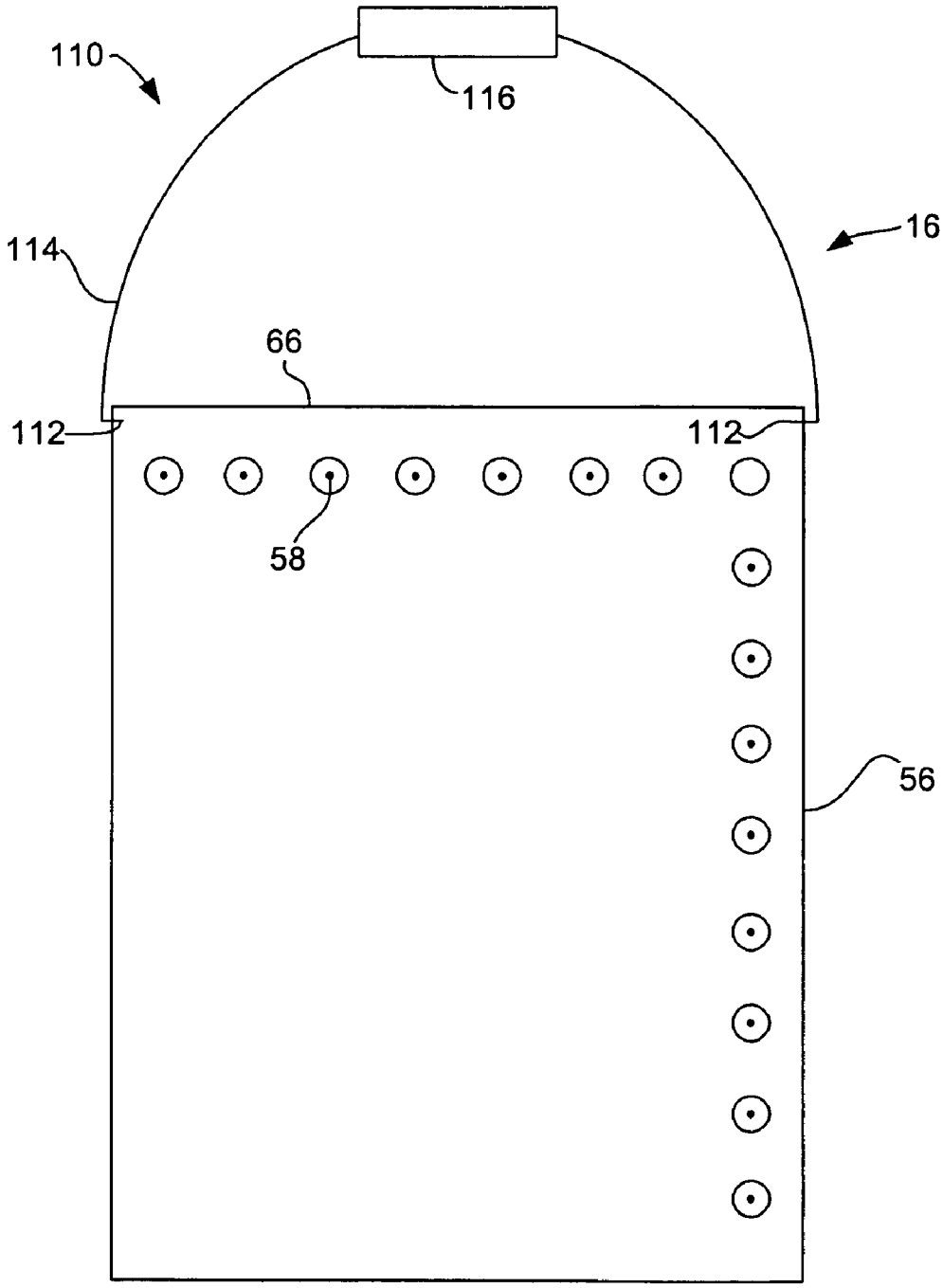
FIG. 5 is a side view of the cooking drum shown in FIG. 1.

FIG. 5 is a side view of cooking drum 16 illustrating openings 58. Although only a single row and a single column of openings 58 are shown in FIG. 5, it is to be understood that openings 58 extend along an entire length of side wall 56. In one embodiment, openings 58 have a 0.75 inch diameter and are spaced 1.5 inches from center in both directions. Cooking drum 16 includes a handle 110 attached near top 66 of side wall 56. Side wall 56 includes a pair of openings (not shown) and ends 112 of handle 110 are positioned within the openings. In one embodiment, handle 110 is a single steel rod formed into an arc. In another embodiment, handle 110 has two attachment portions 114 connected to a gripping portion 116. Attachment portions 114 are fabricated from metal and gripping portion 116 is fabricated from a material that does not conduct heat.

Figure 6:
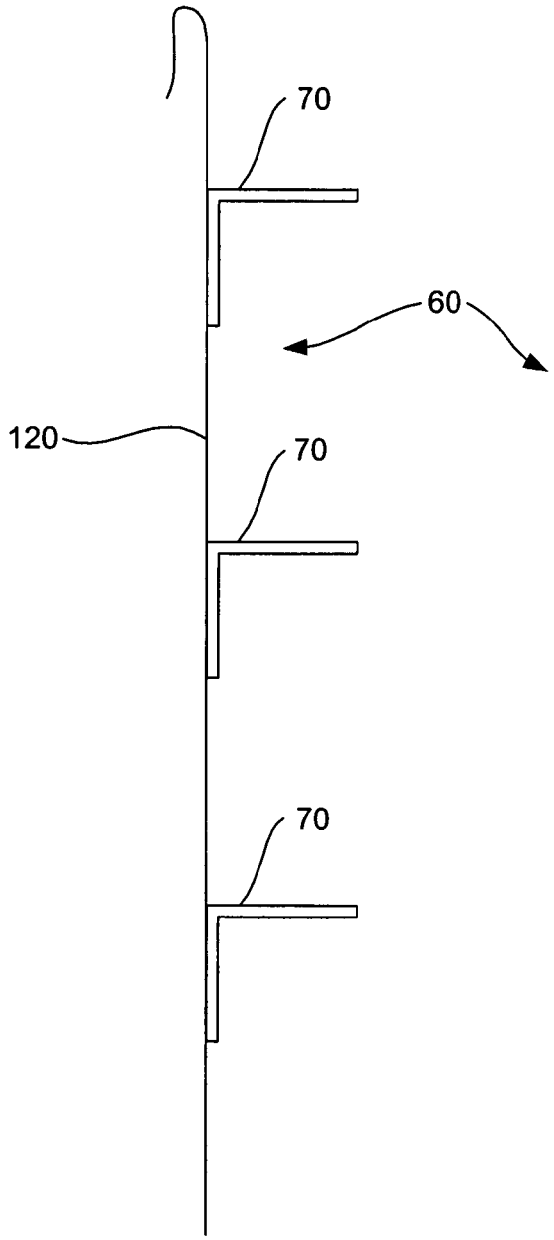
FIG. 6 is a side view of a rack holder shown in FIG. 1.
Figure 7:
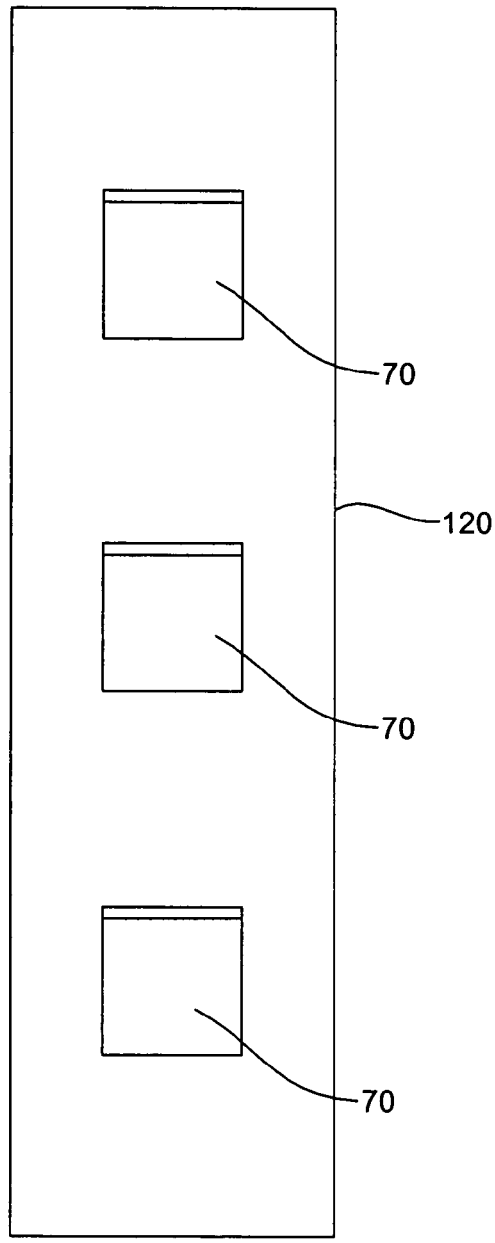
FIG. 7 is a front view of the rack holder shown in FIG. 6.

FIGS. 6 and 7 are side and front views, respectively, of rack holder 60. Rack holder 60 includes a longitudinal member 120 and three extension members 70 connected to longitudinal member 120 and extending from longitudinal member 120 substantially perpendicularly thereto. Extension members 70 are attached to longitudinal member 120 by welding. In alternative embodiments, extension members 70 are attached to longitudinal member 120 by rivets, pins, screws, bolts, or soldering. The number of extension members depends on the number of racks to be placed within cooking area 74 (not shown in FIGS. 6 and 7). Although three extension members are shown in FIGS. 6 and 7, it is to be understood that more or less than three extension members may be attached to longitudinal member 120.

Figure 8:
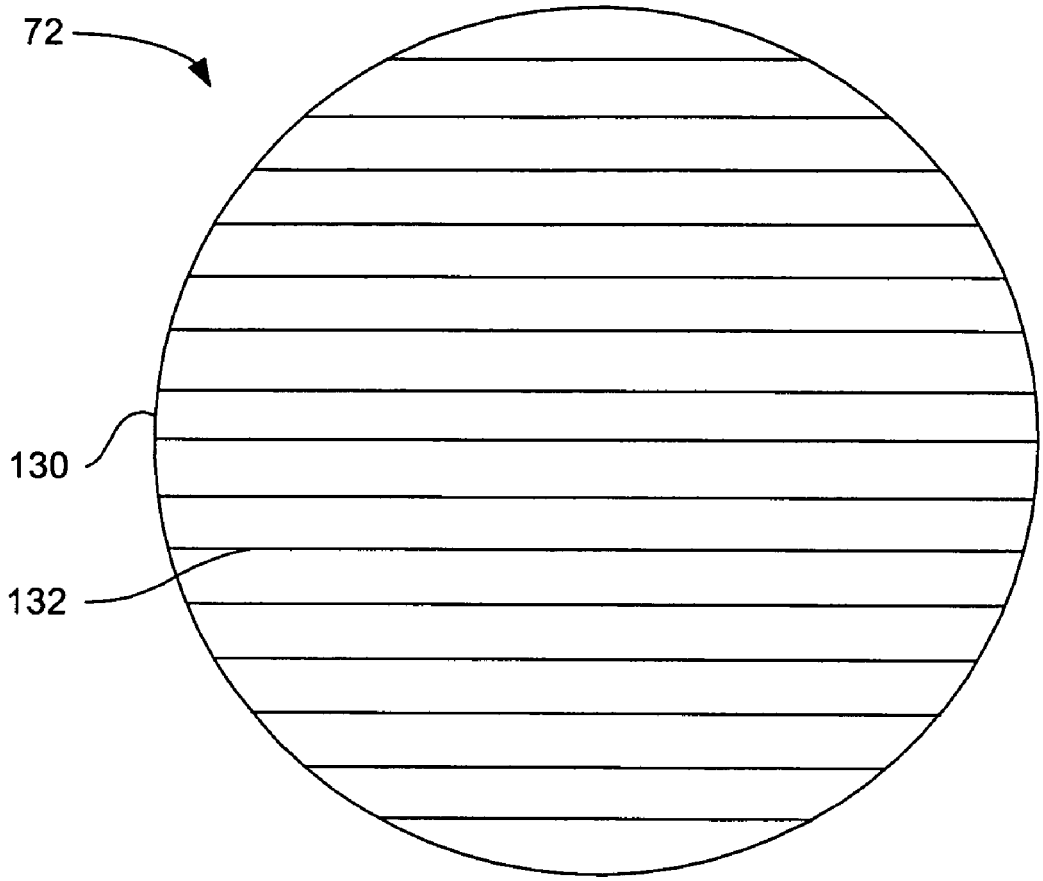
FIG. 8 is a cooking rack to be utilized with the cooking unit shown in FIG. 1.

FIG. 8 illustrates rack 72 to be used in cooking unit 10. Rack 72 is a standard rack used for cooking. It includes a circular member 130 and a plurality of substantially parallel members 132 connected to circular member 130. Alternatively, racks other than rack 72 can be utilized with cooking unit 10. Although the figures illustrate racks 72 contained within cooking drum 16, other types of cooking devices could also be used. For example, food could be placed on a stationary fork mounted to either base 20 or side wall 56. Alternatively, food could be placed on a rotisserie that is mounted to either base 20 or side wall 56.

Figure 9:
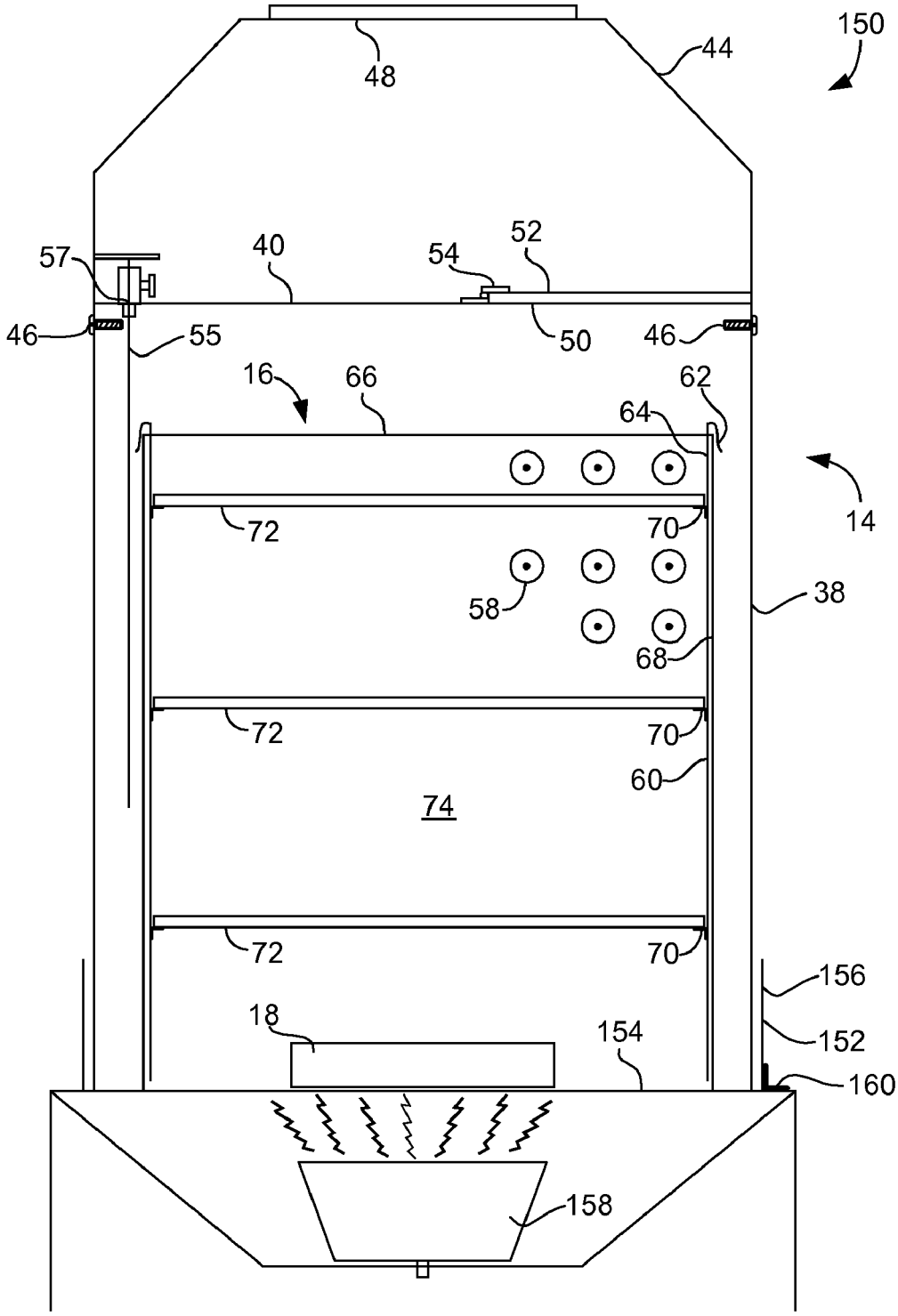
FIG. 9 is a cross sectional view of another cooking unit including a base pan, a can, and a cooking drum.

FIG. 9 illustrates another embodiment of a cooking unit 150. Reference numbers used in FIG. 9 that are identical to reference numbers used in FIGS. 1-8 represent identical elements. Cooking unit 150 includes a base pan 152, can 14, cooking drum 16, and drip pan 18. Base pan 152 includes a base 154 and an outer wall 156 extending from base 154. A heat source 158 is positioned beneath base 154 and under cooking area 74. Heat source 158 is, in one embodiment, a gas burner fed by a propane tank. Alternatively, heat source 158 is an electric heat source. In a further embodiment, heat source 158 is an open flame fed by at least one of wood, charcoal, and other flammable materials.

In one embodiment, outer wall 156 is unitary with base 154. In an alternative embodiment, wall 156 is connected to base 154 by welding or fasteners. In a further embodiment, outer wall 156 is positioned on base 154 and held in place with a plurality of retainers such as clips 160.

Cooking unit 10 is assembled by placing base pan 12 on a flat level surface and positioning drip pan 18 in a center of base 20. Cooking drum 16 is positioned onto base 20 such that drip pan 18 fits within cooking area 74 created by side wall 56. Rack holders 60 are positioned on side wall 56 and racks 72 are positioned on rack holders 60. Can 14 is then placed around cooking drum 14 such that inner wall 22 of base pan 12 circumscribes can side wall 38 and can side wall 38 circumscribes side wall 56 of cooking drum 16.

In use, after base pan 12 is set up with charcoal inside opening 32, the charcoal is lit. Once the charcoal is hot, drip pan 18 is positioned at about a center of base 20. Cooking drum 16 is then placed around drip pan 18 on base 20. A first rack 72 is positioned on extension members 70 and a first portion of food is placed on first rack 72. A second rack 72 is then placed on the next level of extension members and a second portion of the food is then placed on the second rack 72. A third rack 72 is placed on a third level of extension members 70 and a third portion of food is placed on third rack 72. Can 14 is placed over cooking drum 16 and onto base 20 such that base pan inner wall 22 circumscribes can side wall 38.

The food is allowed to cook for an appropriate time and can 14 is removed from base 20. The user has the option of either removing the food from cooking drum 16 at the cooking location or removing cooking drum 16 utilizing handle 110 and transferring cooking drum 16 to a more convenient location for food removal. After the cooking is finished, base pan covering member is adjusted such that it contacts both base pan inner wall 22 and outer wall 24. This allows the charcoal to be conserved and used for the next cooking adventure.

Without being bound by any particular theory, it is believed that the food is cooked by the following process. The heat source conducts heat from outside of the cooking area to the center of the base pan. This heat then vaporizes the grease and generates smoke that convects throughout the perforated drum. It is believed that the airborne grease and smoke plays an important role in cooking the meat and providing the outdoor flavor.

While the invention has been described in terms of various specific embodiments, those skilled in the art will recognize that the invention can be practiced with modification within the spirit and scope of the claims.

What is claimed is:

1. A cooking unit comprising:

a base pan comprising a base, an inner wall having an inner surface and an outer surface, and an outer wall also having an inner surface and an outer surface, said inner wall and said outer wall configured to retain a heat source therebetween, said base configured to retain said heat source above said base, said inner wall and said outer wall extend from said base such that said outer wall is substantially perpendicular to said base and said inner wall is substantially parallel to said outer wall, and said outer wall defining at least one opening that extends therethrough to facilitate providing air to the heat source;

a can positioned on said base pan, said inner wall configured to extend around said can; and a cooking drum located on said base pan and within said can, said cooking drum comprising a tubular side wall.

2. A cooking unit in accordance with claim 1 wherein said can comprises a tubular side wall, a top attached to said side wall, a door, and a handle attached to said side wall, said top having an opening extending therethrough and said door configured to cover at least a portion of said opening.

3. A cooking unit in accordance with claim 1 wherein said cooking drum comprises a handle attached to said side wall, said side wall comprising a plurality of openings extending therethrough.

4. A cooking unit in accordance with claim 1 further comprising at least one rack holder attached to said cooking drum side wall, said rack holder comprising at least one extension.

5. A cooking unit in accordance with claim 4 wherein said at least one rack holder comprises a lip configured to extend over a top of said cooking drum.

6. A cooking unit in accordance with claim 1 wherein said base pan further comprises a plurality of feet extending from said base.

7. A cooking unit in accordance with claim 1 wherein said base pan further comprises:

an annular covering member extending around said can and from said outer wall to said inner wall such that a space exists between said inner wall and said covering member, said space configured to channel heat toward said can.

8. A cooking unit in accordance with claim 1 further comprising a drip pan positioned on said base pan within said cooking drum.

9. A cooking unit in accordance with claim 2 further comprising a fill opening extending through said top and configured to at least partially hold a thermometer.

10. A cooking unit comprising:

a base pan comprising a base, a first wall, a second wall, and an annular covering member, said first wall and said second wall configured to retain a heat source therebetween, said first wall positioned radially inward of said second wall, said base configured to retain said heat source above said base, said first wall and said second wall extend from said base such that said first wall and said second wall are substantially perpendicular to said base, said second wall defining at least one opening that extends therethrough to facilitate providing air to the heat source;

a can comprising a side wall and a top connected to said side wall, said can configured to rest on said base pan, said first wall configured to extend around said can and define a space between said can and said first wall, said annular covering member extending around said can and from said second wall toward said first wall such that a space is defined between said first wall and said covering member, said space configured to channel heat toward said can; and a cooking drum comprising a tubular side wall, said cooking drum configured to rest on said base pan and within said can.

11. A cooking unit in accordance with claim 10 wherein said can further comprises a door attached to said top and a handle attached to said side wall, said top having an opening extending therethrough and said door configured to cover at least a portion of said opening.

12. A cooking unit in accordance with claim 10 wherein said cooking drum comprises a handle attached to said side wall, said cooking unit further comprising at least one rack holder attached to said cooking drum side wall, said rack holder comprising at least one extension and a lip configured to extend over a top of said cooking drum.

13. A cooking unit in accordance with claim 10 further comprising a fill opening extending through said top configured to at least partially hold a thermometer.

* * * * *